United States Patent [19]

Perry

[11] Patent Number: 4,650,232

[45] Date of Patent: Mar. 17, 1987

[54] MANHOLE COVER LIFTER

[76] Inventor: Scott Perry, R.F.D. #2, North Berwick, Me. 03906

[21] Appl. No.: 766,600

[22] Filed: Aug. 19, 1985

[51] Int. Cl.[4] ..... B66F 11/00

[52] U.S. Cl. ..... 294/15; 254/131

[58] Field of Search ..... 294/15, 17, 16, 62; 254/131, 132, 120, 16, 17, 209, 243, 256, 251, 261, 1, 88; 248/156, 346

[56] References Cited

U.S. PATENT DOCUMENTS

| | | | |
|---|---|---|---|
| 2,249,603 | 7/1941 | Elkington | 254/131 |
| 3,837,622 | 9/1974 | Gale | 294/15 |
| 4,482,182 | 11/1984 | Mortensen | 254/131 |

*Primary Examiner*—James B. Marbert

*Attorney, Agent, or Firm*—William Nitkin

[57] ABSTRACT

A manhole cover lifter usable by an individual including means to clear receipt notches on the manhole cover and means to engage a portion thereof under the manhole cover against its reinforcement brace(s) to pull said cover out of its frame and to return said cover to said frame without the need of manually lifting the cover.

4 Claims, 7 Drawing Figures

MANHOLE COVER LIFTER

BACKGROUND OF THE INVENTION

1. Field of the Invention

The device of this invention resides in the area of manhole cover lifters and more particularly relates to an improved manhole cover lifter having means to clean out and gain access into manhole cover rim notches and means to lift and move said manhole cover out of the manhole frame without having to manually lift the manhole cover.

2. Description of the Prior Art

Manhole covers, although particularly well known with regard to sewer systems, are also used in many different types of in-ground installations. To gain access to a manhole in the ground, one must first lift and remove the manhole cover therefrom. Manhole covers are heavy and often can weigh in excess of 180 lbs. The standard practice in the prior art has been to jam a crowbar into a notch located at the rim of the manhole cover, pry the cover up and then manually lift it out. This procedure frequently causes problems in that the manhole cover is extremely heavy and persons lifting out the cover can strain muscles trying to pry it up and lift it out. Moreover, the notch(es) around the cover's perimeter can be filled with tar and other debris which the compaction thereof can prevent easy insertion of the pry bar. Further, the manhole cover, when lifted out, can fall on the worker's hands and feet causing serious injury.

A body of art has developed which includes the following U.S. patents:

U.S. Pat. No. 3,275,299 Meshew
U.S. Pat. No. 3,985,338 Herrmann
U.S. Pat. No. 4,365,925 Girtz
U.S. Pat. No. 4,482,182 Mortensen Some of the prior art devices disclosed in the above-mentioned patents have means to latch onto holes defined within the manhole cover, either at a side or at a center point thereof and to lock thereon so that the device and cover can be rotated on a pivot member of the device, and the cover lifted out. One problem with some of the above-mentioned prior art is that some manhole covers in current use do not have such holes extending all the way therethrough. Many manhole covers today have a receipt notch in one or more positions around their perimeter, and it is this notch which is felt most practical to address because it is so commonly used. One device that does address the lifting of this type of manhole is disclosed in U.S. Pat. No. 4,482,182 to Mortensen listed above. The device as disclosed has means to latch into opposing notches on each side of the cover by means of a complex mechanism so that such cover can be lifted out by the use of such tool. A problem with prior art tools is that often due to the complexity of the tool and/or tightly sealed-in covers such tools are difficult to use.

SUMMARY OF THE INVENTION

It has long been felt desirable to develop a safe and easy-to-use manhole cover lifter. Therefore it is an object of this invention to provide a non-complex, simplified tool which can be utilized by an individual with the currently existing sytle of receipt notched manhole covers.

It is a further object to remove such manhole cover without the necessity of an individual manually touching or handling the cover.

It is yet a still further object of this invention to remove such covers with ease even if the receipt notches in the cover are plugged with tar or debris.

The body of the tool disclosed herein terminates with a tip member which is curved and is adapted to be inserted into a receipt notch in the manhole cover. A handle positioned perpendicular to the body allows the user to first manipulate the tool to insert the tip into the notch. One then rotates the handle back and forth which movement twists the curved tip member which action drives it into the receipt notch, clearing away any debris or tar from the receipt notch so that the tip can be inserted further therein. One then pulls back on the handle, lifting the cover upwards and somewhat out of the manhole frame. A shovel or other bar-like implement can then be inserted under the cover to hold it up, and the tool removed from the notch. The tool is then rotated 90 degrees sideways and pushed under the cover and once under the cover, the tool is rotated back again to its original position wherein a tooth formed on the end of the tool extends upward under and engages into the reinforcement braces which are found under most manhole covers. The tool is pulled backwards by the handle with the tooth pulling the manhole cover out of the frame. The device of this invention then can be rested on the ground with the handle acting as a stabilizer which handle prevents the device from rotating and falling over. One can leave the manhole cover resting on the tool of this invention if desired. To return the cover, one merely lifts the upper handle on the curved portion of the tool and slides the cover on the tool back toward and then into the manhole frame again into a position where the manhole cover is seated on the cover seat rim of the manhole frame. One then twists the tool 90 degrees, disengaging the tooth from the cover's reinforcement brace's and pulls the tool out from under the manhole cover which stays in position and falls the short remaining distance onto its seat.

DESCRIPTION OF THE PREFERRED EMBODIMENT(S)

Figure 1:
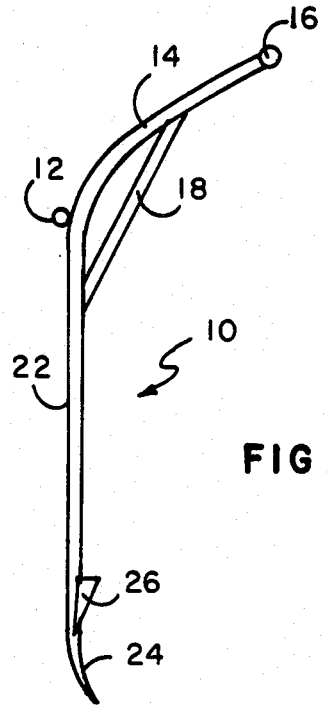
FIG. 1 illustrates a side view of the tool of this invention.
Figure 2:
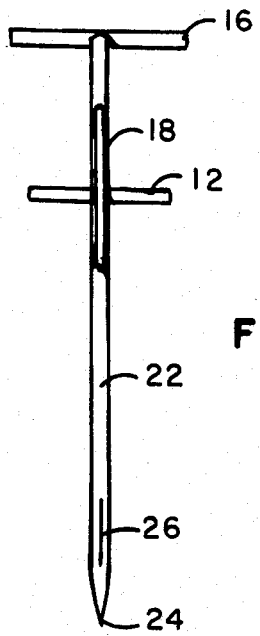
FIG. 2 illustrates a front view of the tool of this invention.

FIG. 1 illustrates a side view of the tool of this invention which shows the body 22 and the end of first handle 12 perpendicular thereto. The tool is seen in greater detail in FIG. 2 which is a front view positioned 90 degrees to the view shown in FIG. 1. The second handle 16 seen on top of the tool where body 22 curves from the position of handle 12 and extends as handle portion 14 which can be reinforced by brace 18 if needed. At the bottom of the tool is tooth 26 and curved tip 24 which is used to engage manhole cover notch 28 as seen in FIG. 3.

Figure 3:
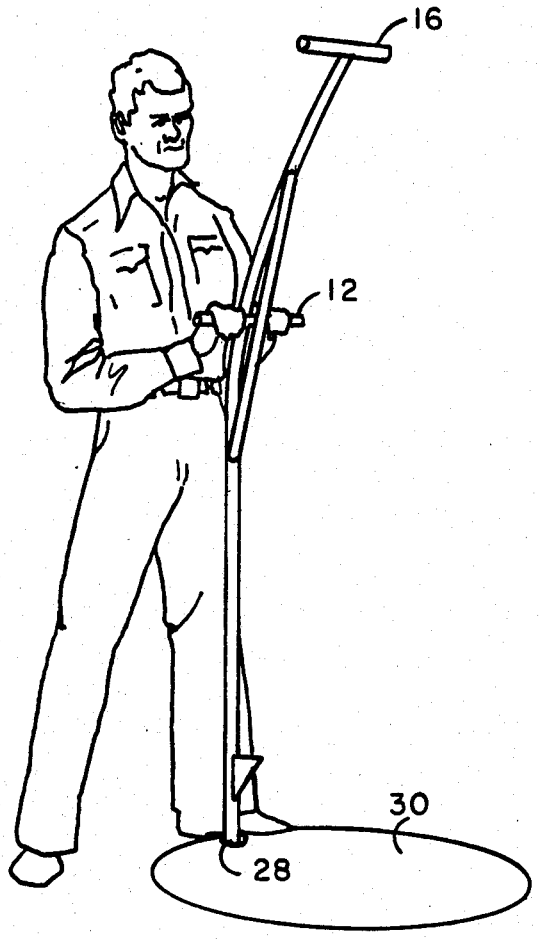
FIG. 3 illustrates the tool of this invention in use cleaning out a notch in a manhole cover.
Figure 4:
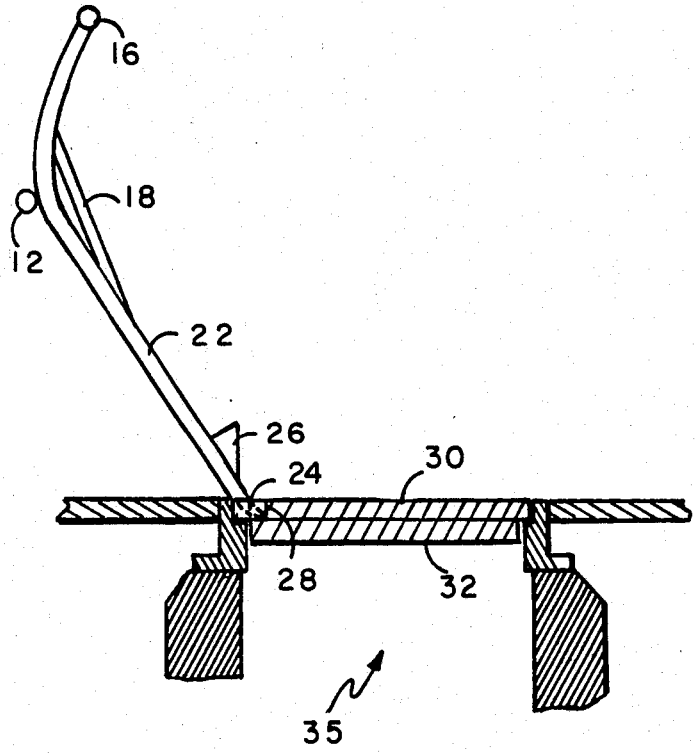
FIG. 4 illustrates a cutaway view of the tool in the manhole cover's notch.
Figure 5:
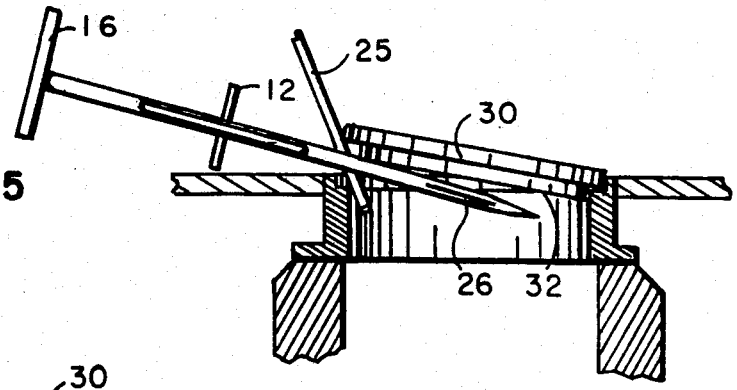
FIG. 5 illustrates the tool being inserted under a manhole cover.
Figure 6:
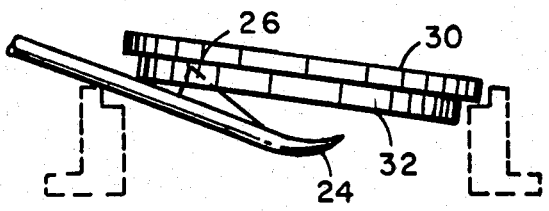
FIG. 6 illustrates the tool being rotated so that its tooth engages the manhole cover's reinforcement brace(s).
Figure 7:
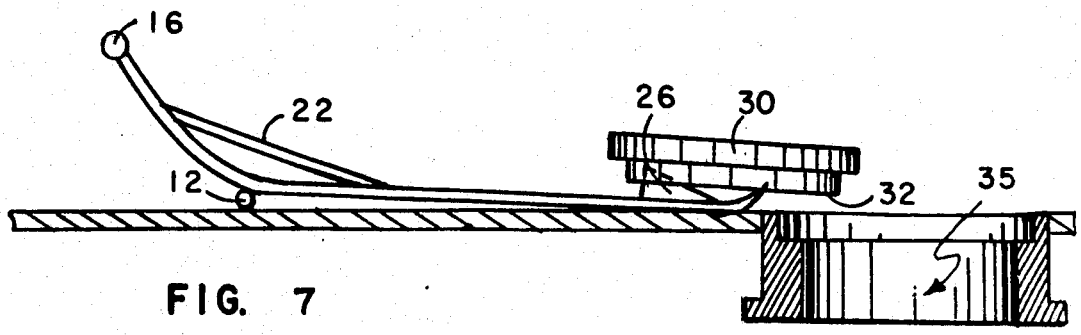
FIG. 7 illustrates a manhole cover resting on the tool of this invention.

In FIG. 3 a user is shown rotating the tool by handle 12 causing curved tip 24 to clear debris out of notch 28 of manhole cover 30. Once the notch is cleaned out as seen in FIG. 4, one inserts the curved tip into notch 28 of the cover and pries upwards using the rear of the tool touching the rim and/or the ground as a fulcrum. When the cover is lifted away from the frame, one inserts a shovel or other suitable tool 25 under the cover to hold a side of the cover clear of the frame with a space therebetween. One then rotates the tool 90 degrees as seen in FIG. 5 and pushes it under the manhole cover. One then rotates the tool back to its original position having tooth 26 as seen in FIG. 6 engage upwards against reinforcement brace 32 of manhole cover 30. The manhole cover is then pulled out of manhole 35 as seen in FIG. 7, and the tool can then be rested on the ground. The tool will not fall over and will maintain its position because handle 12 is then used as a stand to hold the tool upright. Most current manhole covers have braces underneath of one type or another against which the tooth can engage. Although the configuration of the braces may differ from manhole to manhole, there is always some underlying cover structure which tooth 26 can latch onto when the tool is pulled or pushed moving the cover back into its original position. Once the cover is returned onto the manhole frame by pushing it while it rests on the tool, the tool is rotated 90 degrees, disengaging the tooth from the reinforcement braces of the cover and is slid out from under the cover. The cover then falls the remaining short distance onto its seat.

Although the present invention has been described with reference to particular embodiments, it will be apparent to those skilled in the art that variations and modifications can be substituted therefor without departing from the principles and spirit of the invention.

I claim:

1. A manhole cover lifter for lifting covers of the type having receipt notches defined in their sides and reinforcement braces located on their bottoms, comprising:

a body member having first and second ends;

a curved pointed tip at said first end of said body member adapted for insertion into one of said receipt notches to lift a portion of said manhole cover upwards from said manhole;

a tooth member disposed on said body member adjacent to said curved tip extending upward from said body member in a plane aligned with said curved tip, said tooth member adapted to engage said reinforcement braces when said first end of said body member is inserted under said lifted portion of said manhole cover;

a first handle positioned on said body member perpendicular to the direction of the extension of said tooth member, said positioning being approximately between said first and second ends, said handle being substantially straight and extending at both sides of said body member adapted to act as a lever to rotate said body member and curved tip when inserting said tip into said receipt notch, said first handle also adapted to act as a stand member when said body member is laid on the ground;

said body member curving as it extends beyond said first handle; and a second handle positioned at said second end of said body member, said second handle being a substantially straight member and extending at both sides of said body member perpendicular to the direction of said tooth member to act as a handle to move said lifter when said lifter is laid on the ground.

2. The lifter of claim 1 further including:

a brace member extending from a first portion of said body member between said first handle and said tooth member to a second portion of said body member between said first handle and said second handle.

3. A method of lifting a manhole cover of the type having receipt notches in its side and reinforcement braces thereunder out of a manhole opening, comprising the steps of:

providing a manhole cover lifter having:

a body member having first and second ends;

a curved pointed tip at said first end of said body member adapted for insertion into one of said receipt notches to lift a portion of said manhole cover upwards from said manhole;

a tooth member disposed on said body member adjacent to said curved tip extending upward from said body member in a plane aligned with said curved tip, said tooth member adapted to engage said reinforcement braces when said first end of said body member is inserted under said lifted portion of said manhole cover;

a first handle positioned on said body member perpendicular to the direction of the extension of said tooth member, said positioning being approximately between said first and second ends, said handle being substantially straight and extending at both sides of said body member adapted to act as a lever to rotate said body member and curved tip when inserting said tip into said receipt notch, said first handle also adapted to act as a stand member when said body member is laid on the ground;

said body member curving as it extends beyond said first handle; and a second handle positioned at said second end of said body member, said second handle being a substantially straight member and extending at both sides of said body member perpendicular to the direction of said tooth member to act as a handle to move said lifter when said lifter is laid on the ground;

entering the curved tip of said lifter into one of said receipt notches;

rotating said first handle causing said curved tip to move in said receipt notch;

clearing out any tar or debris in said receipt notch by said movement of said curved tip;

forcing said second handle downward;

using a portion of said lifter body as a fulcrum against the ground and/or manhole frame;

lifting a portion of said manhole cover out of said frame by the upwards movement of said curved tip in said receipt notch;

entering an object such as a shovel under the open portion of said manhole cover between said manhole cover and said frame;

removing said curved tip from said receipt notch;

rotating said lifter 90 degrees;

sliding the first end of said lifter with said curved tip and tooth member under said manhole cover;

rotating said lifter 90 degrees back to its original position;

engaging said tooth against a reinforcement brace under said manhole cover;

pulling said second handle;

removing said manhole cover from said frame by said pulling action, a portion of said manhole cover then resting on said lifter;

resting said lifter on the ground; and supporting said lifter in an upright position by said first handle.

4. The method of claim 3 further including steps to return said manhole cover to its position on the seat of said manhole frame, comprising the steps of:

lifting said second handle;

pulling said lifter and manhole cover thereon back onto the manhole frame;

rotating said lifter 90 degrees;

disengaging said lifter's tooth from said manhole cover's reinforcement braces;

sliding said lifter out from under said manhole cover; and allowing said manhole cover to fall back on its seat in said manhole frame.

* * * * *